United States Patent [19]

Daniel et al.

[11] Patent Number: 4,545,221

[45] Date of Patent: Oct. 8, 1985

[54] ADJUSTMENT AND CLEANING OF THE VENTURI GAP IN A DYEING MACHINE

[75] Inventors: Winfield C. Daniel; Richard K. Sitterding, both of Altavista, Va.

[73] Assignee: Burlington Industries, Inc., Greensboro, N.C.

[21] Appl. No.: 515,858

[22] Filed: Jul. 21, 1983

[51] Int. Cl.[4] ..... D06B 3/28

[52] U.S. Cl. ..... 68/181 R; 68/177; 138/43; 239/456; 251/251

[58] Field of Search ..... 68/177, 178, 181 R; 366/134, 178, 341; 239/456; 251/121, 122, 124, 251, 325; 138/114, 43, 45

[56] References Cited

U.S. PATENT DOCUMENTS

| | | | |
|---|---|---|---|
| 1,003,700 | 9/1911 | Busch | 239/456 X |
| 1,969,638 | 8/1934 | Culp . | |
| 2,436,845 | 3/1948 | Wiler | 138/114 X |
| 2,806,741 | 9/1957 | Fishelson et al. | 239/456 |
| 2,978,291 | 4/1961 | Fahringer | 8/151 |
| 3,192,710 | 7/1965 | Wilson, Jr. | 239/456 X |
| 4,129,017 | 12/1978 | Greer | 68/177 X |
| 4,174,361 | 11/1979 | Rollins | 261/41 B |
| 4,250,856 | 2/1981 | Abbey | 123/439 |
| 4,308,835 | 1/1982 | Abbey | 123/439 |

FOREIGN PATENT DOCUMENTS

| | | | |
|---|---|---|---|
| 191633 | 1/1923 | United Kingdom . | |
| 955953 | 9/1982 | U.S.S.R. | 239/456 |

OTHER PUBLICATIONS

Gaston County Material for an Adjustable Jet, Circa 1973–1975, Instruction Sheet and Drawings.

*Primary Examiner*—Philip R. Coe

*Attorney, Agent, or Firm*—Cushman, Darby & Cushman

[57] ABSTRACT

An actuating mechanism for varying the Venturi gap of a jet dyeing machine allows adjustment of the gap between a zero spacing (for easy centering) and a self-cleaning, fully open position, adjustment being provided without interrupting production. As is conventional, a textile material passing pipe is reciprocal within an outlet pipe, with an end of the textile material passing pipe forming a Venturi with a circumferential lip formed on the interior of the outlet pipe. A cam and follower mechanism is mounted exteriorly of the textile material-passing pipe between it and the outlet pipe, with a cam shaft extending through the outlet pipe wall to an exterior position. Power means, which may be responsive to sensors for sensing fabric flow and liquid flow, effect rotation of the cam shaft to effect reciprocation of the textile material-passing pipe, and thus adjustment of the Venturi gap.

19 Claims, 5 Drawing Figures

ADJUSTMENT AND CLEANING OF THE VENTURI GAP IN A DYEING MACHINE

BACKGROUND AND SUMMARY OF THE INVENTION

Jet dyeing machines are effective mechanisms for the dyeing of fabric, and other textile materials, in rope form. A typical jet dyeing machine is shown in U.S. Pat. No. 2,978,291, the disclosure of which is hereby incorporated by reference herein.

In conventional jet dyeing machines, a Venturi gap is provided between a first, textile material passing, pipe and an outlet pipe. The Venturi gap can be adjusted but only by interrupting production and adjusting the first pipe with respect to the outlet pipe. This is generally done by rotating the first pipe, with exterior threads on the first pipe cooperating with interior threads on the outlet pipe to transform the rotation into relative reciprocation therebetween, or by removing the first pipe entirely from the operating position in the outlet pipe and placing shims of varying thicknesses onto a flange located internally of the outlet pipe, thereby changing the axial location of the first pipe when it is replaced into its operating location and an external flange on the first pipe comes to rest on the shim, or by any other means that may be provided by the design of individual dyeing machines. This means that in all cases production must be interrupted whenever it is desired to vary the Venturi gap for any reason, or even where one merely desires to clean the Venturi gap after it has been clogged by foreign material (which periodically happens during normal operations).

According to the present invention, apparatus is provided for use in jet dyeing machines which overcomes the drawbacks of the prior art. According to the present invention it is possible to vary the Venturi gap without interrupting production. The gap may be varied from a zero position, useful for centering, to a fully open self-cleaning position. Not only is this accomplished without interruption of the process, the components which provide for such adjustment are isolated from the fabric and liquid flow paths, and do not in any way interfere with dyeing of the fabric.

As in conventional in the prior art, the apparatus according to the present invention comprises: a first, textile material passing, pipe, having proximate and distal ends; an outlet pipe generally concentric and in line with said first pipe, and at least said proximate end of said first pipe disposed within said outlet pipe; a second, treatment liquid, inlet pipe, generally transverse to said outlet pipe, and opening into said outlet pipe at a portion thereof between said proximate and distal ends of said first pipe; a circumferentialprojection formed on the interior of said outlet pipe downstream of the proximate end of said first pipe, said proximate end of said first pipe and said circumferential projection forming a Venturi; and means for reciprocating said first pipe with respect to said outlet pipe to vary the spacing between said circumferential projection and said first pipe proximate end, and thereby vary said Venturi. According to the invention, the means for reciprocating said first pipe further comprises means for varying said Venturi gap from a first position wherein said gap is closed, providing a position for accurately centering the Venturi, and a second position wherein said gap is opened sufficiently so that said Venturi is self-cleaning, or any position therebetween said Venturi gap being variable without interrupting production of treated textile material with said apparatus.

The reciprocating means according to the invention comprises a cam and cam follower mechanism disposed exteriorly of the first pipe, and between it and the interior wall of the outlet pipe. Said cam follower comrpises a block of material having a cam-receiving opening formed therein, said block of material rigidly attached to the external periphery of said first pipe between said distal and proximate ends thereof; and wherein said cam comprises an eccentric circular disc disposed within said cam follower cam-receiving opening and essentially filling said opening; and further comprising a cam shaft eccentric with said cam and extending radially outwardly from said first pipe through said outlet pipe to a position exterior of said outlet pipe. Said cam shaft passes through bushing means providing for relative rotational movement of said ccam shaft with respect to said outlet pipe, but preventing other movement of said cam shaft with respect to said outlet pipe; and wherein said first pipe is mounted for at least a small angular rotation within said outlet pipe.

The cam shaft may be actuated by power means, and may be actuated automatically. For instance sensors may be provided for determining the fabric speed and the liquid flow rate, and the power means may be actuated automatically in response to such sensing. Additionally, a timer may be provided for automatically operating the power means after a predetermined period of operation of the apparatus to effect self-cleaning.

To facilitate guidance of the first pipe during reciprocation thereof, at least three bolts may be provided extending radially inwardly through the outlet pipe walls to engage the exterior surface of the first pipe between the proximate and distal ends thereof. The bolts guide reciprocation of the first pipe without scoring the exterior surface thereof.

It is the primary object of the present invention to provide an improved apparatus for varying the Venturi gap in a conventional jet dyeing machine or the like. This and other objects of the invention will become clear from an inspection of the detailed description of the invention, and from the appended claims.

DETAILED DESCRIPTION OF THE INVENTION

Figure 1:
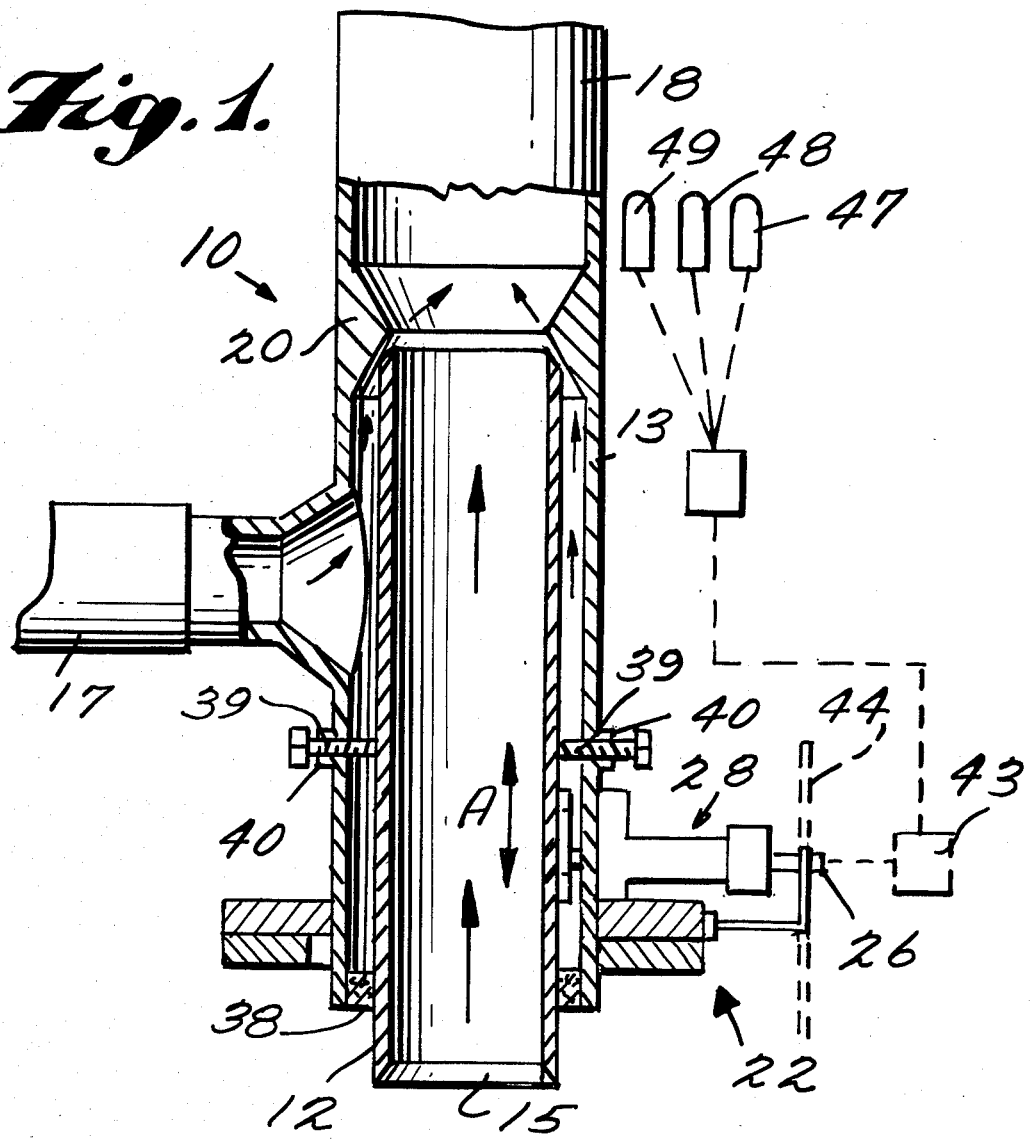
FIG. 1 is a side detail view, partly in cross-section and partly in elevation, of exemplary apparatus according to the present invention.

Exemplary apparatus according to the present invention is shown generally by reference numeral 10 in FIG. 1. The apparatus is generally located within or without a vessel containing dyeing liquid, and in which fabric or like textile material to be treated is circulated, such as shown in U.S. Pat. No. 2,978,291, the disclosure of which is hereby incorporated by reference herein.

Generally conventional components of the apparatus according to the invention include a first, textile material passing pipe 12, and an outlet pipe 13. The outlet pipe 13 is generally concentric with the first pipe 12. The first pipe 12 includes proximate 14 and distal 15 ends thereof, and at least the proximate end 14 is disposed within the outlet pipe 13.

Operatively connected to the outlet pipe 13 between the ends 14, 15 of the first pipe 12 is a second, liquid inlet, pipe 17. Liquid is recirculated from the vessel through the pipe 17, to pass exteriorly of the pipe 12 and to flow upwardly to the top portion 18 of pipe 13. As illustrated in said U.S. Pat. No. 2,978,291 the top portion 18 of pipe 13 may be semi-circular or may have any other suitable configuration to return the fabric and the liquid to the interior of the vessel.

A Venturi is formed between the proximate end 14 of the first pipe 12 and the circumferential lip 20 formed interiorly of the outlet pipe 13. The lip 20 is formed downstream of the point of connection of the second pipe 17 to the outlet pipe 13. Means are provided for varying the linear position of the pipe 12 with respect to the circumferential lip 20 to thereby adjust the Venturi gap.

According to the present invention, the means—shown generally by reference numeral 22—for reciprocating the first pipe 12 with respect to the outlet pipe 13 allow adjustment of the Venturi gap without interrupting production. The Venturi gap can be adjusted from zero inches—at which position centering is accomplished—to a fully opened position whereby self-cleaning of the Venturi is effected. The reciprocating means 22 is disposed so that it is isolated from the flow of the liquid and the passage of the textile material being treated, so that such actuating means do not adversely affect the treatment process.

The actuating means 22 according to the present invention are most clearly illustrated in FIGS. 2 through 5. The actuating means include a cam follower 24 which comprises a block of material rigidly fixed to the exterior wall of the pipe 12 between the distal end 15 thereof and the interconnection of the second pipe 17 to the outlet pipe 13. The block of material 24 includes means defining a cam-receiving opening therein, and an eccentric cam 25 substantially fills that opening—as seen most clearly in FIG. 3. Extending radially outwardly from the pipe 12 is the cam shaft 26 which is eccentric with the cam 25. Rotation of the cam shaft 26 effects rotation of the cam 25, and thus—through cam follower 24—reciprocation of the pipe 12 in dimension A—A (see FIGS. 1 and 2).

Mounting the shaft 26 for rotation about its axis—which is essentially perpendicular to the dimension A—A—are bushing means shown generally by reference numeral 28. The bushing means include a cam shaft adaptor 30 (see FIGS. 2 and 5) which receives the cam shaft 26 in an opening 31 (see FIG. 5) therein. Adaptor 30 is rigidly connected to the exterior surface of the outlet pipe 13, as seen most clearly in FIG. 2. Packing material 32 surrounds the shaft 26, and a capping mechanism, formed by components 33 and 34, caps the top of the adaptor 30 and holds the packing material 32 in place.

A cam shaft retainer 36 releasably holds the shaft 26 in its operating position. By releasing the retainer 36, the shaft 26 may be removed, however, and the entire unit replaced. The bushings means 28 mounts the shaft 26 so that it is rotatable with respect to the outlet tube 13, but so that no other relative movement between the shaft 26 and the outlet tube 13 is provided.

Figure 3:
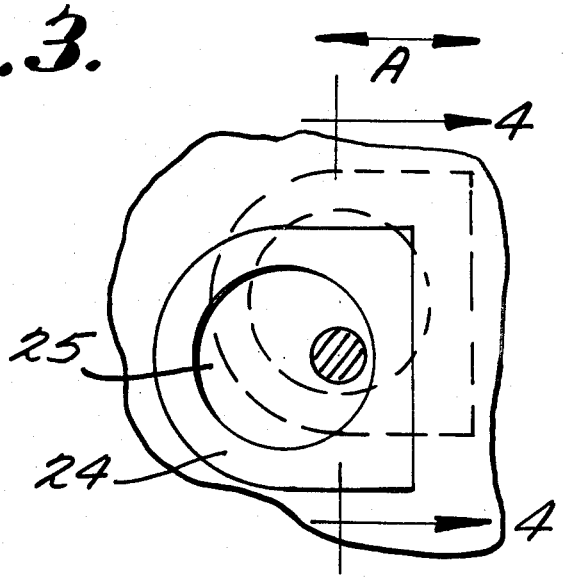
FIG. 3 is a detail view of the mechanism of FIG. 2 taken along lines 3—3 thereof.
Figure 2:
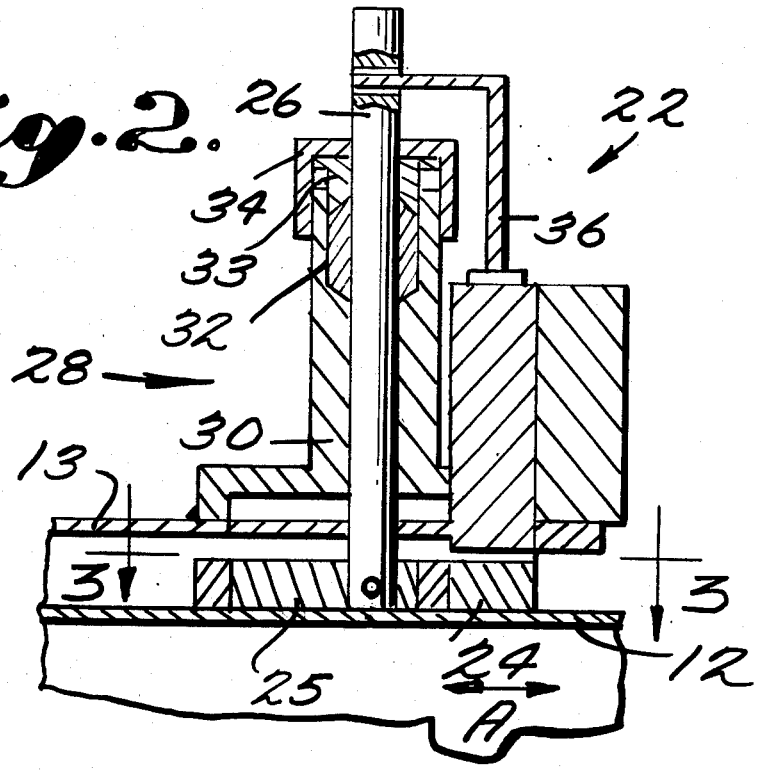
FIG. 2 is a detail cross-sectional view of the cam actuating mechanism of the apparatus of FIG. 1.
Figure 5:
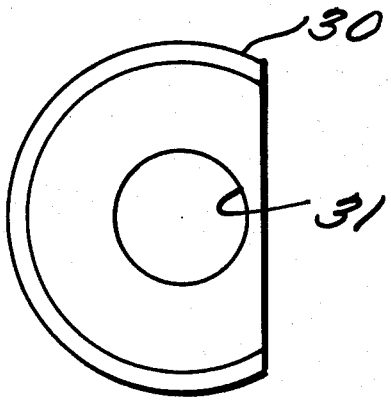
FIG. 5 is a bottom plan view of the cam shaft adaptor of the apparatus of FIG. 2.
Figure 4:
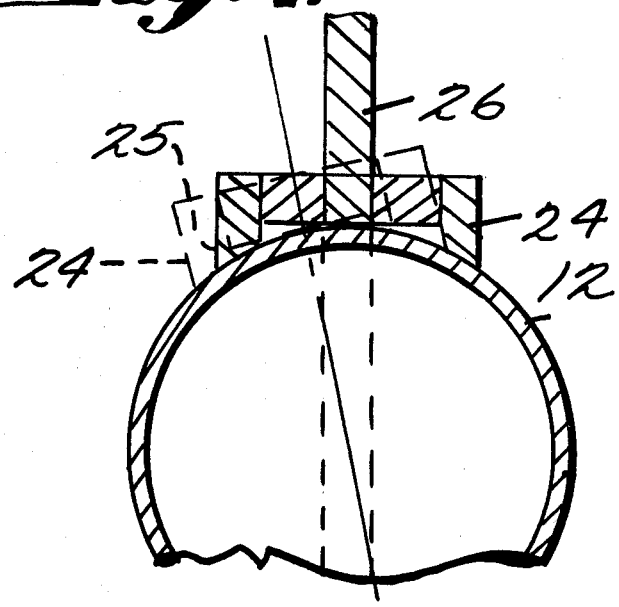
FIG. 4 is a cross-sectional view taken along lines 4—4 of FIG. 3.

To allow the cam 25, when rotated, to effect the desired translation of the first pipe 12, the pipe 12 must also be mounted for at least a small angular amount of rotation with respect to the outlet pipe 13. This is provided merely by the loose packing and sealing material 38 at the end of the outlet pipe 13 between the outlet pipe 13 and the exterior of the first pipe 12, and by centering bolts 39. The slight angular rotation of the cam follower 24—and pipe 12 rigidly attached thereto—is illustrated in dotted line in FIG. 4. The translation of pipe 12 in dimension A, combined with a small angular rotation thereof, is also illustrated in FIG. 3 (compare the solid line and dotted line positions of the follower 24 and cam 25, the shaft 26 maintaining the same linear position although itself being rotated about its axis).

In order to guide and center the tube 12 during its reciprocation in dimension A, at least three centering bolts 39 are preferebly provided. These bolts penetrate the outlet pipe 13 and extend axially inwardly, engaging the exterior surface of the pipe 12. A jam nut 40 is provided with each centering bolt 39. While the centering bolts 39 engage the exterior of the pipe 12, they are formed of such material—relative to the material of the pipe 12—and are tightened down in such a way so that no scoring of the pipe 12 takes place as a result of relative movement between the pipe 12 and the bolts 39.

While any suitable means may be utilized for rotating the shaft 26, preferably a power means 43 (see FIG. 1) is provided. If the apparatus 10 is located interiorly of the vessel, the power means preferably is disposed exteriorly of the vessel wall —the vessel wall being shown schematically in dotted line by reference numeral 44 in FIG. 1—containing the apparatus 10. In this case, the bushing means 28 would preferably be mounted on the vessel wall exterior, and axially with the extended cam shaft 26. Only a light bushing will be necessary at the point where the shaft 26 penetrates the wall of the outlet pipe 13. Prior art generally utilizes the apparatus 10 located on the outside of the vessel, in which case the assembly represented by FIG. 1 would apply, without the necessity of the shaft 10 penetrating the vessel wall 44. Of course, the actuating means 22 may be disposed in any location on the circumference of outlet pipe 13, as may be convenient to connect and operate the power means 43.

The power means 43 may be actuated by a manually actuated switch, and/or by an automatic control. For instance a microprocessor control 46 may be provided for controlling the power means 43, the microprocessor control 46 connected up to one or more sensors or other electronic components 47–49. Preferably, the sensor 47 is disposed in operative association with the second pipe 17 to sense the flow rate of liquid through the Venturi. The sensor 48 is preferably associated with the pipe 12 to sense the fabric speed therethrough. The component 49 may be an automatic timer which effects operation of the control 46 after the passage of a predetermined period of production time to override all other inputs to the control 46, and move the pipe 12 so that the Venturi is in self-cleaning position.

Operation

Once all the components of the apparatus 10 are connected together, the cam shaft 26 is rotated, as by hand, to move the proximate end 14 of the pipe 12 into contact with the lip 20, and thus provide the zero position of the Venturi. Then the centering bolts 39 are moved so that they are in operative association with the exterior of the pipe 12, and the pipe 12 is centered within the pipe 13. The power means 43 are actuated to move the pipe 12 in dimension A to provide the desired Venturi gap, and the flow of dyeing liquor through the pipe 17, and cloth to be treated through the pipe 12, is started. The sensors 47, 48—through controller 46 —control the power means 43 to control the desired Venturi gap.

Upon rotation of shaft 26 by the power means 43, the shaft 26 rotates cam 25, which causes follower 24—and pipe 12 connected thereto—to both translate in dimension A, and to rotate a small angular amount with respect to the pipe 13.

When self-cleaning of the Venturi is desired, by manual actuation—or by actuation of the timer 49—the power means 43 effects movement of the proximate end 14 of the pipe 12 a maximum spacing from the circumferential lip 20, to thereby provide self-cleaning. This is accomplished without interruption of the production process.

It will thus be seen that according to the present invention a simple, effective, and efficient mechanism has been provided for adjusting the Venturi gap in a jet dyeing machine, or the like, without interrupting production. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

WHAT IS CLAIMED IS:

1. In an apparatus for the liquid treatment of textile material in rope form: a first, textile material passing, pipe, having proximate and distal ends; an outlet pipe generally concentric and in line with said first pipe, and at least said proximate end of said first pipe disposed within said outlet pipe; a second, treatment liquid, inlet pipe, generally transverse to said outlet pipe, and opening into said outlet pipe at a portion thereof between said proximate and distal ends of said first pipe; a circumferential projection formed on the interior of said outlet pipe downstream of the proximate end of said first pipe, said proximate end of said first pipe and said circumferential projection forming a Venturi; means for reciprocating said first pipe with respect to said outlet pipe to vary the spacing between said circumferential projection and said first pipe proximate end, and thereby vary said Venturi; said first pipe reciprocating means comprising means for engaging said first pipe at a portion thereof on the opposite side of said second pipe from said first pipe proximate end; said engaging means: actuatable from the exterior of said outlet pipe; and isolated from the flow of treatment liquid in said second pipe and through said Venturi; and isolated from the flow of textile material through said first pipe; and non-concentric with said first pipe; said means for reciprocating said first pipe comprising a cam and a cam follower mechanism disposed exteriorly of said first pipe between said first pipe and the interior wall of said outlet pipe, and disposed between the distal end of said first pipe and the opening of said second pipe into said outlet pipe.

2. In an apparatus for the liquid treatment of textile material in rope form: a first, textile material passing, pipe, having proximate and distal ends; an outlet pipe generally concentric and in line with said first pipe, and at least said proximate end of said first pipe disposed within said outlet pipe; a second, treatment liquid, inlet pipe, generally transverse to said outlet pipe, and opening into said outlet pipe at a portion thereof between said proximate and distal ends of said first pipe; a circumferential projection formed on the interior of said outlet pipe downstream of the proximate end of said first pipe, said proximate end of said first pipe and said circumferential projection forming a Venturi; and means for reciprocating said first pipe with respect to said outlet pipe to vary the spacing between said circumferential projection and said first pipe proximate end, and thereby vary said Venturi;

said first pipe reciprocating means comprising a cam and a cam follower mechanism mounted exteriorly of said first pipe between said first pipe and the interior wall of said outlet pipe, and between said first pipe distal end and said second pipe connection to said outlet pipe.

3. Apparatus as recited in claim 1 wherein said means for reciprocating said first pipe further comprises means for varying said Venturi gap from a first position wherein said gap is closed, providing a position for accurately centering the Venturi, to a second position wherein said gap is opened sufficiently so that said Venturi is self-cleaning, said Venturi gap being variable without interrupting production of treated textile material with said apparatus.

4. Apparatus as recited in claim 2 wherein said means for reciprocating said first pipe further comprises means for varying said Venturi gap from a first position wherein said gap is closed, providing a position for accurately centering the Venturi, to a second position wherein said gap is opened sufficiently so that said Venturi is self-cleaning, said Venturi gap being variable without interrupting production of treated textile material with said apparatus.

5. Apparatus as recited in claim 1 wherein said cam follower comprises a block of material having a cam receiving opening formed therein, said block of material rigidly attached to the external periphery of said first pipe between said distal and proximate ends thereof; and wherein said cam comprises an eccentric circular disc disposed within said cam follower cam-receiving opening and esentially filling said opening; and further comprising a cam shaft eccentric with said cam and extending radially outwardly from said first pipe through said outlet pipe to a position exterior of said outlet pipe.

6. Apparatus as recited in claim 5 wherein said cam shaft passes through bushing means providing for relative rotational movement of said cam shaft with respect to said outlet pipe, but preventing other movement of said cam shaft with respect to said outlet pipe; and wherein said first pipe is mounted for at least a small angular rotation within said outlet pipe.

7. Apparatus as recited in claim 6 further comprising power means for rotating said cam shaft to effect reciprocation of said first pipe.

8. Apparatus as recited in claim 7 further comprising means for sensing the flow of liquid through said second pipe, and means for sensing the textile material speed through said first pipe; and control means for controlling said power means in response to said liquid flow and textile material speed sensing means.

9. Apparatus as recited in claim 1 further comprising at least three centering bolts extending radially inwardly through said outlet pipe and operatively engaging the exterior surface of said first pipe between said proximate and distal ends thereof, said centering bolts centering the reciprocatory movement of said first pipe with respect to said outlet pipe.

10. Apparatus as recited in claim 2 further comprising at least three centering bolts extending radially inwardly through said outlet pipe and operatively engaging the exterior surface of said first pipe between said proximate and distal ends thereof, said centering bolts centering the reciprocatory movement of said first pipe with respect to said outlet pipe.

11. Apparatus as recited in claim 2 wherein said cam follower comprises a block of material having a cam receiving opening formed therein, said block of material rigidly attached to the external periphery of said first pipe between said distal and proximate ends thereof, and wherein said cam comprises an eccentric circular disc disposed within said cam follower cam-receiving opening and essentially filling said opening; and further comprising a cam shaft eccentric with said cam and extending radially outwardly from said first pipe through said outlet pipe to a position exterior of said outlet pipe.

12. Apparatus as recited in claim 11 wherein said cam shaft passes through bushing means providing for relative rotational movement of said cam shaft with respect to said outlet pipe, but preventing other movement of said cam shaft with respect to said outlet pipe, and wherein said first pipe is mounted for at least a small angular rotation within said outlet pipe.

13. Apparatus as recited in claim 11 further comprising power means for rotating said cam shaft to effect reciprocation of said first pipe.

14. Apparatus as recited in claim 13 further comprising means for sensing the flow of liquid through said second pipe, and means for sensing the textile material speed through said first pipe; and control means for controlling said power means in response to said liquid flow and textile material speed sensing means.

15. Apparatus as recited in claim 2 where said means for reciprocating said first pipe comprises power means; and further comprising means for sensing the flow of liquid through said second pipe, and means for sensing the textile material speed through said first pipe; and control means for controlling said power means in response to said liquid flow and textile material speed sensing means.

16. In an apparatus for the liquid treatment of textile material in rope form: a first, textile material passing, pipe, having proximate and distal ends; an outlet pipe generally concentric and in line with said first pipe, and at least said proximate end of said first pipe disposed within said outlet pipe; a second, treatment liquid, inlet pipe, generally transverse to said outlet pipe, and opening into said outlet pipe at a portion thereof between said proximate and distal ends of said first pipe; a circumferential projection formed on the interior of said outlet pipe downstream of the proximate end of said first pipe, said proximate end of said first pipe and said circumferential projection forming a Venturi; and power means for reciprocating said first pipe with respect to said outlet pipe to vary the spacing between said circumferential projection and said first pipe proximate end, and thereby vary said Venturi;

said first pipe reciprocating power means comprising: means actuatable from the exterior of said outlet pipe, isolated from the flow of treatment liquid in said second pipe and through said Venturi, isolated from the flow of textile material through said first pipe, and non-concentric with said first pipe; means for sensing the flow of liquid through said second pipe; and means for sensing the textile material speed through said first pipe; and control means for controlling said power means in response to said liquid flow and textile material speed sensing means.

17. Apparatus as recited in claim 16 wherein said means for reciprocating said first pipe comprises a cam and a cam follower mechanism disposed exteriorly of said first pipe between said first pipe and the interior wall of said outlet pipe, and disposed between the distal end of said first pipe and the opening of said second pipe into said outlet pipe.

18. Apparatus as recited in claim 17 wherein said cam follower comprises a block of material having a cam receiving opening formed therein, said block of material rigidly attached to the external periphery of said first pipe between said distal and proximate ends thereof; and wherein said cam comprises an eccentric circular disc disposed within said cam follower cam receiving opening and essentially filling said opening; and further comprising a cam shaft eccentric with said cam and extending radially outwardly from said first pipe through said outlet pipe to a position exterior of said outlet pipe.

19. In an apparatus for the liquid treatment of textile material in rope form: a first, textile material passing, pipe, having proximate and distal ends; an outlet pipe generally concentric and in line with said first pipe, and at least said proximate end of said first pipe disposed within said outlet pipe; a second, treatment liquid, inlet pipe, generally transverse to said outlet pipe, and opening into said outlet pipe at a portion thereof between said proximate and distal ends of said first pipe; a circumferential projection formed on the interior of said outlet pipe downstream of the proximate end of said first pipe, said proximate end of said first pipe and said circumferential projection forming a Venturi; power means for reciprocating said first pipe with respect to said outlet pipe to vary the spacing between said circumferential projection and said first pipe proximate end, and thereby vary said Venturi; said first pipe reciprocating means power means comprising means for engaging said first pipe at a portion thereof on the opposite side of said second pipe from said first pipe proximate end; said engaging means: actuatable from the exterior of said outlet pipe; and isolated from the flow of treatment liquid in said second pipe and through said Venturi; and isolated from the flow of textile material through said first pipe; and non-concentric with said first pipe; comprising means for sensing the flow of liquid through said second pipe, and means for sensing the textile material speed through said first pipe; and control means for controlling said power means in response to said liquid flow and textile material speed sensing means.

* * * * *

Disclaimer and Dedication 4,545,221.—*Winfield C. Daniel; Richard K. Sitterding*, both of Altavista, Va. ADJUSTMENT AND CLEANING OF THE VENTURI GAP IN A DYEING MACHINE. Patent dated Oct. 8, 1985. Disclaimer and Dedication filed May 1, 1989, by the assignee, Burlington Industries, Inc.

Hereby disclaims and dedicates to the Public the term of this patent subsequent to Oct. 8, 1989.